US009530267B1

(12) United States Patent
Hu et al.

(10) Patent No.: US 9,530,267 B1
(45) Date of Patent: Dec. 27, 2016

(54) COIN HOPPER HAVING AN IMPROVED COIN PUSHING DESIGN

(71) Applicant: INTERNATIONAL CURRENCY TECHNOLOGIES CORPORATION, Taipei (TW)

(72) Inventors: Chia-Hung Hu, Taipei (TW); Yi-Hsin Chen, Taipei (TW)

(73) Assignee: INTERNATIONAL CURRENCY TECHNOLOGIES CORPORATION, Taipei (TW)

( * ) Notice: Subject to any disclaimer, the term of this patent is extended or adjusted under 35 U.S.C. 154(b) by 0 days.

(21) Appl. No.: 14/735,558

(22) Filed: Jun. 10, 2015

(51) Int. Cl.
*G07D 1/00* (2006.01)
*G07D 9/00* (2006.01)

(52) U.S. Cl.
CPC ..... *G07D 1/00* (2013.01); *G07D 9/008* (2013.01); *G07D 2201/00* (2013.01)

(58) Field of Classification Search
CPC ..... G07D 1/00; G07D 9/08; G07D 2201/00
USPC ..... 453/34, 35, 49, 50, 53, 57
See application file for complete search history.

(56) References Cited

U.S. PATENT DOCUMENTS 3,902,511 A * 9/1975 Jacobs ..... G07D 9/008 453/32
2006/0223428 A1* 10/2006 Fujii ..... G07D 1/00 453/57
2007/0212997 A1* 9/2007 Kurosawa ..... G07D 9/008 453/49

* cited by examiner

*Primary Examiner* — Mark Beauchaine
(74) *Attorney, Agent, or Firm* — Muncy, Geissler, Olds & Lowe, P.C.

(57) ABSTRACT

A coin hopper includes a hopper body including a housing having an accommodation chamber defined in a funnel-shaped coin box thereof and a coin outlet for guiding coins out of the accommodation chamber individually, a rotating wheel having multiple coin-pushing blades extended from a wheel base thereof and a coin-receiving space defined between each two adjacent coin-pushing blades, each coin-pushing blade having an abutment edge extending along one lateral side thereof for stopping one coin in one coin-receiving space and a pushing edge extending along an opposite lateral side thereof, a power drive adapted for rotating the rotating wheel to let coins be ruffled by coin-pushing blades and forced into coin-receiving spaces and then guided by arc-shaped abutment edges to move out of each coin-receiving space upwardly toward coin outlet one after another, and a coin-dispensing mechanism including a spring-loaded lever for pushing coins out of coin outlet individually.

11 Claims, 10 Drawing Sheets

COIN HOPPER HAVING AN IMPROVED COIN PUSHING DESIGN

BACKGROUND OF THE INVENTION

1. Field of the Invention

The present invention relates to coin dispensing technology and more particularly, to a coin hopper having an improved coin pushing design, which comprises a hopper body having a funnel-shaped coin box in a housing thereof, and a rotating wheel mounted in the funnel-shaped coin box and having coin-pushing blades radially and equiangularly spaced around a wheel base thereof and a coin-receiving space defined between each two adjacent coin-pushing blades, wherein when the rotating wheel is rotated, coins are ruffled to fall into the coin-receiving spaces individually, and then pushed into the coin outlet one after another by the coin-pushing blades and coin-receiving spaces for dispensing.

2. Description of the Related Art

A coin hopper is a coin counting device designed for use in a coin exchange machine, gambling machine, amusement machine or vending machine for sending out or issuing coins or token one by one. However, coins or token of different thicknesses, sizes and/or shapes may be used in different countries or different machines.

A conventional coin hopper is known using a motor to rotate a rotating disc for dispensing coins/token. The rotating wheel has a plurality of equiangularly spaced pins. A guide member and a micro switch are respectively mounted in the inner side and outer side of the coin outlet of the coin hopper. During rotation of the rotating wheel, coins/token are pushed one by one by the pins of the rotating wheel toward the coin outlet and then guided out of the coin outlet by the guide member. When one coin/token passes through the coin outlet, it will touch the micro switch, achieving count of the dispensed coin/token. Further, in order to ensure coin hopper operating stability, a coin lever is provided between the rotating wheel and the coin outlet for removing each overlapped coin from the coin being delivered to the coin outlet, avoiding coin jams.

FIG. 9 illustrates a coin hopper according to the prior art design. As illustrated, the coin hopper A comprises a base panel A1, a rotating wheel A2 rotatably mounted at the base panel A1, a coin outlet A10 disposed adjacent to the periphery of the rotating wheel A2, a control plate A3 spaced below the coin outlet A10 and facing toward the rotating wheel A2, a coin ejector A4 comprising a spring-loaded lever A41 and disposed at a top side of the coin outlet A10, a plurality of pressure plates A21 arranged on the rotating wheel A2 and equiangularly spaced around the center thereof, a rib A211 located at each pressure plate A21, and spring members A22 respectively arranged to support the respective pressure plates A21. The control plate A3 comprises a downwardly sloping guide rail A31. When the rotating wheel A2 is rotated counter-clockwise, the rib A211 of each pressure plate A21 pushed one respective coin toward the control plate A3, causing the coin to be abutted against the guide rail A31 of the control plate A3, and thus, the coin is pushed upwardly along the guide rail A31 toward the coin outlet A10. When the rid A211 of one pressure plate A21 is abutted against the guide rail A31, the rib A211 is forced by the guide rail A31 to compress the respective spring member A22, and thus, this rib A211 can be moved downwardly over the control plate A3. At this time, the spring-loaded lever A41 of the coin ejector A4 is returned to eject the coin out of the coin hopper A through the coin outlet A10.

However, when the rotating wheel A2 is rotated at a high speed, the rib A211 at each pressure plate A21 will be forced to hit the control plate A3 heavily, and thus, the pressure plate A21 and the control plate A3 can wear quickly with use. Further, because the spring members A22 are frequently compressed and then released by the respective pressure plates A21, the problem of stress concentration or elastic fatigue can occur easily, causing failure of the retracting function of the ribs A211 of the pressure plate A21 and affecting the coin dispensing operation. Further, the control plate A3 is normally made from a plastic material to minimize the impact and noises produced upon hitting of coins against the control plate A3. However, the control plate A3 can wear out quickly when frequently rubbed by coins. When the control plate A3 starts to wear, coins can be not smoothly moved along the guide rail A31 of the control plate A3 to the coin outlet A10. Replacing the control plate A3 requires much time and labor, increasing the cost.

FIG. 10 illustrates a coin dispenser according to the prior art. As illustrated, the coin dispenser is substantially similar to the aforesaid prior art coin hopper with the difference that the rotating wheel A2 of the coin dispenser has radial rows of abutment blocks A23 arranged on the front wall thereof to constitute radial series of teeth; the control plate A3 has a plurality of grooves A32 concentrically located at an inner side thereof corresponding to the abutment blocks A23. During rotation of the rotating wheel A2, each radial row of abutment blocks A23 is forced to move one respective coin toward the control plate A3, causing the coin to abut against the guide rail A31 of the control plate A3 and then to be moved along the guide rail A31 upwardly toward the coin outlet A10. Further, during rotation of the rotating wheel A2, the abutment blocks A23 are moved through the respective grooves A32 of the control plate A3 without interference, and thus, the rotating wheel A2 can be continuously and smoothly rotated, preventing the ribs A211 of the pressure plate A21 from hitting the control plate A3 to cause structural damage. However, because this design of coin dispenser uses the control plate A3 to work with the rotating wheel A2 for controlling the coin moving direction. Friction between the control plate A3 and coins can still cause the control plate A3 to wear out, affecting the coin dispensing operation and leading to a control plate replacement problem. Improvement in this regard is necessary.

SUMMARY OF THE INVENTION

The present invention has been accomplished under the circumstances in view. It is therefore the main object of the present invention to provide a coin hopper, which comprises a hopper body and a rotating wheel. The hopper body comprises a housing and a power drive. The housing comprises a funnel-shaped coin box, an accommodation chamber defined in the funnel-shaped coin box for accommodating coins to be dispensed, and a coin outlet disposed in communication with the accommodation chamber for guiding coins out of the accommodation chamber individually. The power drive is adapted for rotating the rotating wheel to push coins out of the accommodation chambers into coin outlet individually. The rotating wheel comprises a wheel base pivotally mounted in the housing, a plurality of coin-pushing blades radially and equiangularly extended from the wheel base and a coin-receiving space defined between each two adjacent coin-pushing blades. The coin-pushing blades are curved blades, each having an abutment edge extending along one lateral side thereof and a pushing edge extending along an opposite lateral side thereof. When the rotating wheel is rotated by the power drive, coins are ruffled by the coin-pushing blades of the rotating wheel to fall into the coin-receiving spaces, and then guided by the arc-shaped abutment edges of the coin-pushing blades to move out of each coin-receiving space upwardly toward the coin outlet one after another, achieving coin dispensing. The structural design of the rotating wheel effectively achieves coin dispensing without an extra control plate or back plate. If a plastic control plate or back plate is used, the plastic control plate or back plate can wear out quickly due to friction against coins, leading to coin dispensing problems. Thus, the invention saves much labor and time cost in control plate replacement, enhancing practicability of the coin hopper.

According to another aspect of the present invention, the base panel comprises a through hole cut through opposing front and back walls thereof at a lower side relative to the coin outlet. The hopper body further comprises a coin ejector mounted at the base panel. The coin ejector comprises a leaf spring having a fixed end and an opposing free end, a fastening member affixing the fixed end of the leaf spring to the back wall of the base panel, and a push member located at the free end of the leaf spring and inserted through the through hole of the base panel and floatably suspended in the circular base. If another coin falls into one coin-receiving space at the time the rotating wheel carries one coin from this coin-receiving space to the coin outlet, the push member will push this intruded coin away from the respective coin-pushing blade, preventing jamming of this intruded coin in the gap between the coin-pushing blade and the base panel, or an occurrence of a structural damage.

According to still another aspect of the present invention, if overlapped coins are simultaneously moved by one coin-pushing blade of the rotating wheel, due to that the thickness of the coins is smaller than the height of the coin outlet, a first coin of the overlapped coins can be pushed into the coin outlet and then rapidly ejected out of the coin outlet by the lever of the coin-dispensing mechanism. If a second coin of the overlapped coins is moved with the first coin to the coin outlet, this second coin will be disposed above the height of the coin outlet due to the effect of the thickness of the coin-pushing blades of the rotating wheel, and will then be forced to fall from the surface of the first coin. At this time, the raised bearing portion of the respective coin-pushing blade can touch the second coin or the other coins above the first coin, moving the second coin or the other coins downwardly away from the coin-pushing blades of the rotating wheel. Further, the bevel guide edge of the coin-dispensing strip of each coin-pushing blade can also move the second coin or the other coins downwardly away from the surface of first coin that is been moved into the coin outlet, allowing the first coin to be smoothly moved into the coin outlet and then pushed out of the coin outlet. Thus, the invention effectively prevents the rotating wheel from delivering overlapped coins into the coin outlet to cause jammed coin or coin outlet blockage.

According to still another aspect of the present invention, the funnel-shaped coin box of the housing of the hopper body defines an opening in communication with the accommodation chamber; the base panel is affixed to the back wall of the funnel-shaped coin box, having a circular recess located at the front wall thereof and facing toward the opening and a guide edge extending along the border of the circular recess; the rotating wheel is pivotally mounted at the center of the circular recess. During rotation of the rotating wheel, each coin-pushing blade of the rotating wheel works with one respective coin-receiving space to move one coin toward the coin outlet. At this time, the coin is peripherally abutted against the guide edge around the border of the circular recess, and thus, this coin is moved toward a coin-dispensing mechanism in the coin outlet. The guide edge around the circular recess imparts less friction resistance to the coin, and the coin can be moved into the coin outlet easily and smoothly. When the lever of the coin-dispensing mechanism is squeezed by the coin, it is biased outwardly. Thereafter, the elastic potential energy of the torsion spring returns the lever, causing the lever to eject the coin rapidly out of the coin outlet.

DETAILED DESCRIPTION OF THE PREFERRED EMBODIMENT

Figure 1:
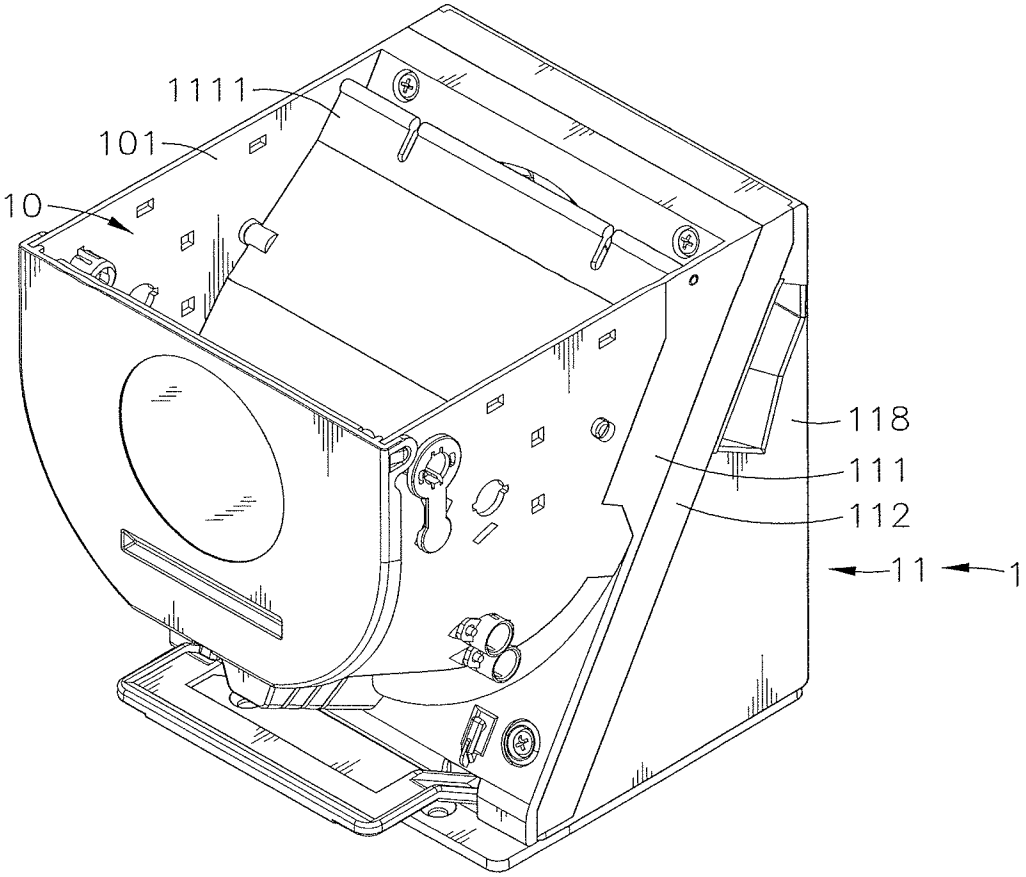
FIG. 1 is an oblique top elevational view of a coin hopper in accordance with the present invention.
Figure 2:
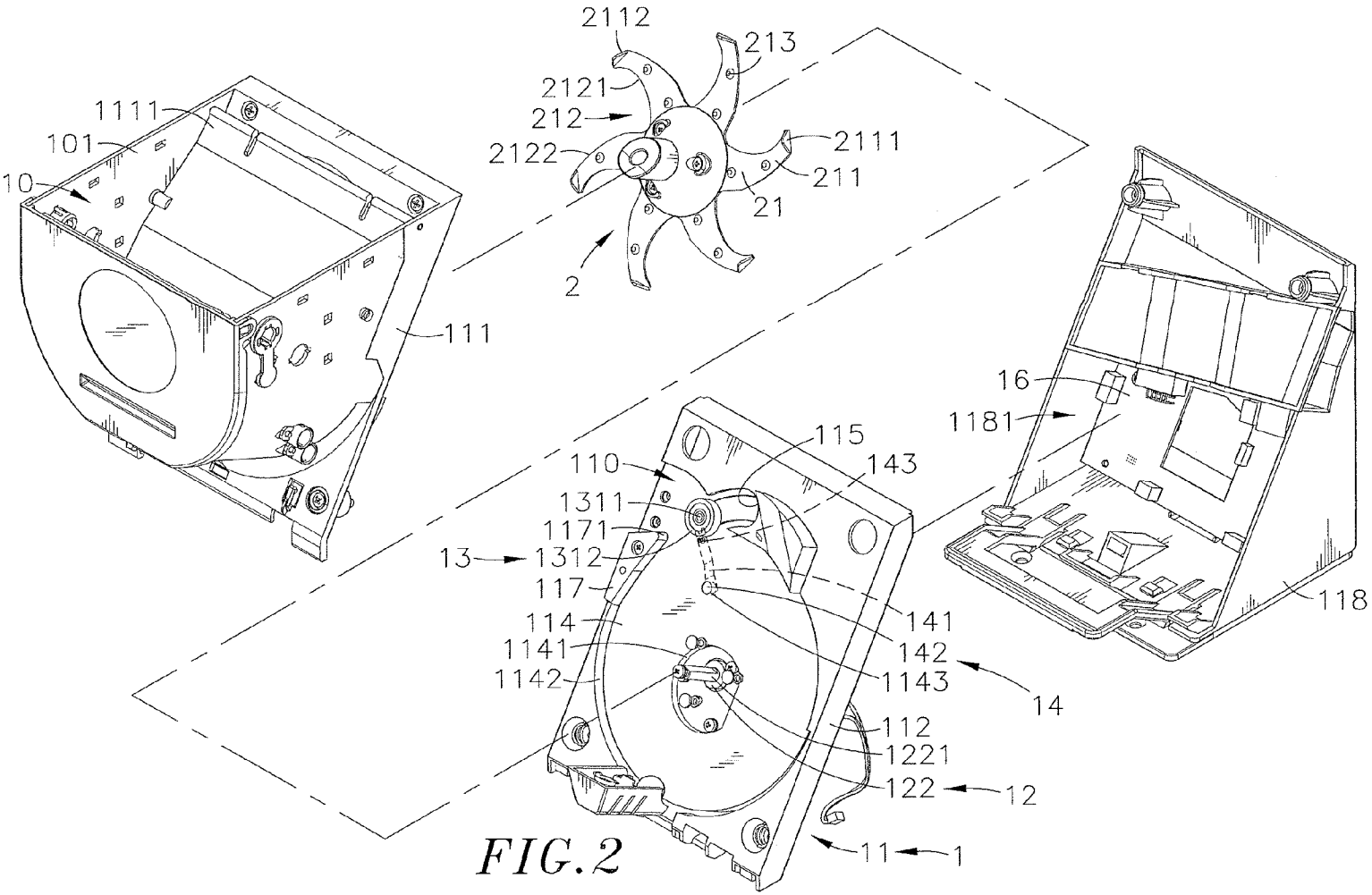
FIG. 2 is an exploded view of the coin hopper in accordance with the present invention.
Figure 3:
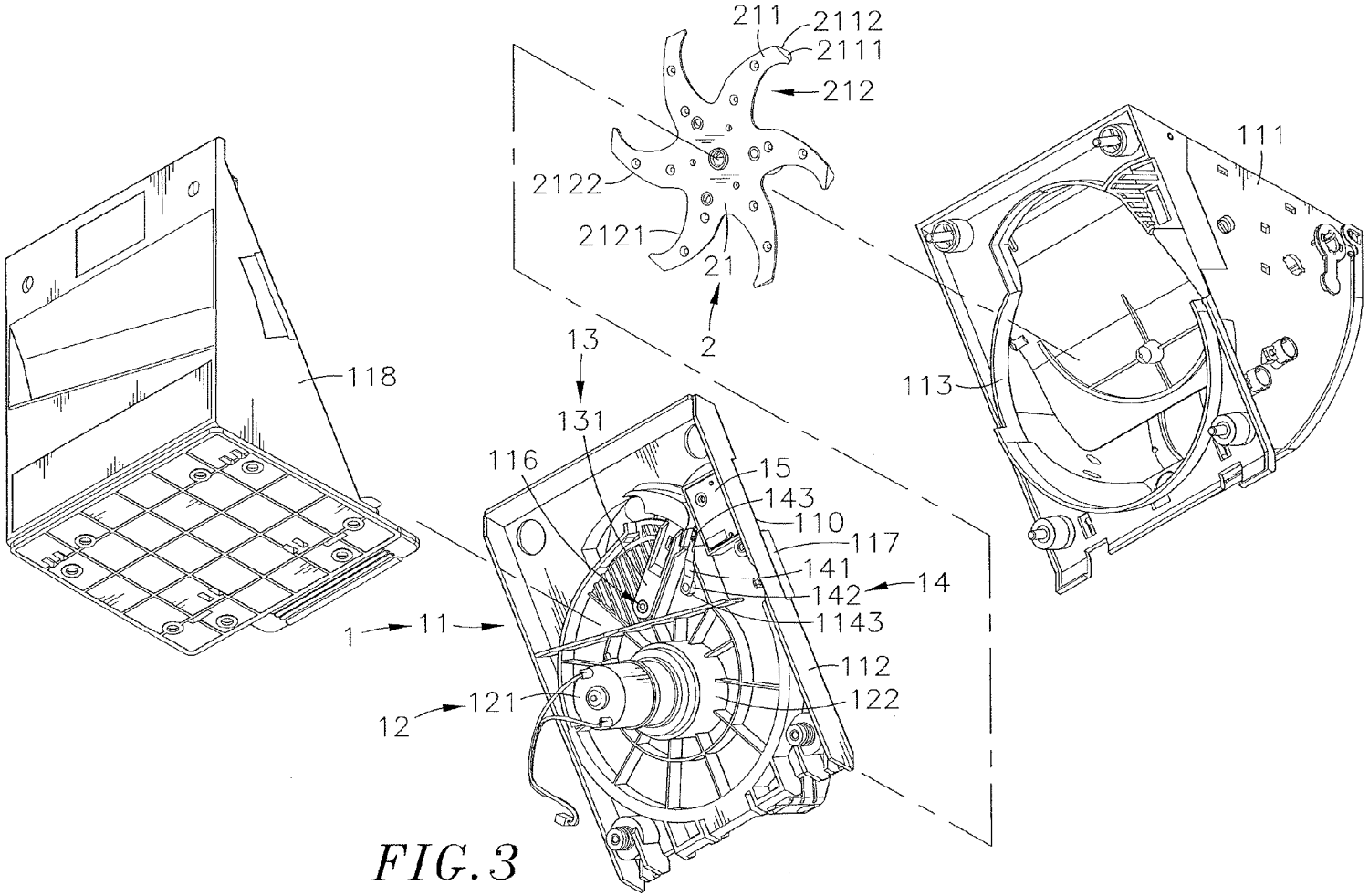
FIG. 3 corresponds to FIG. 2 when viewed from another angle.
Figure 4:
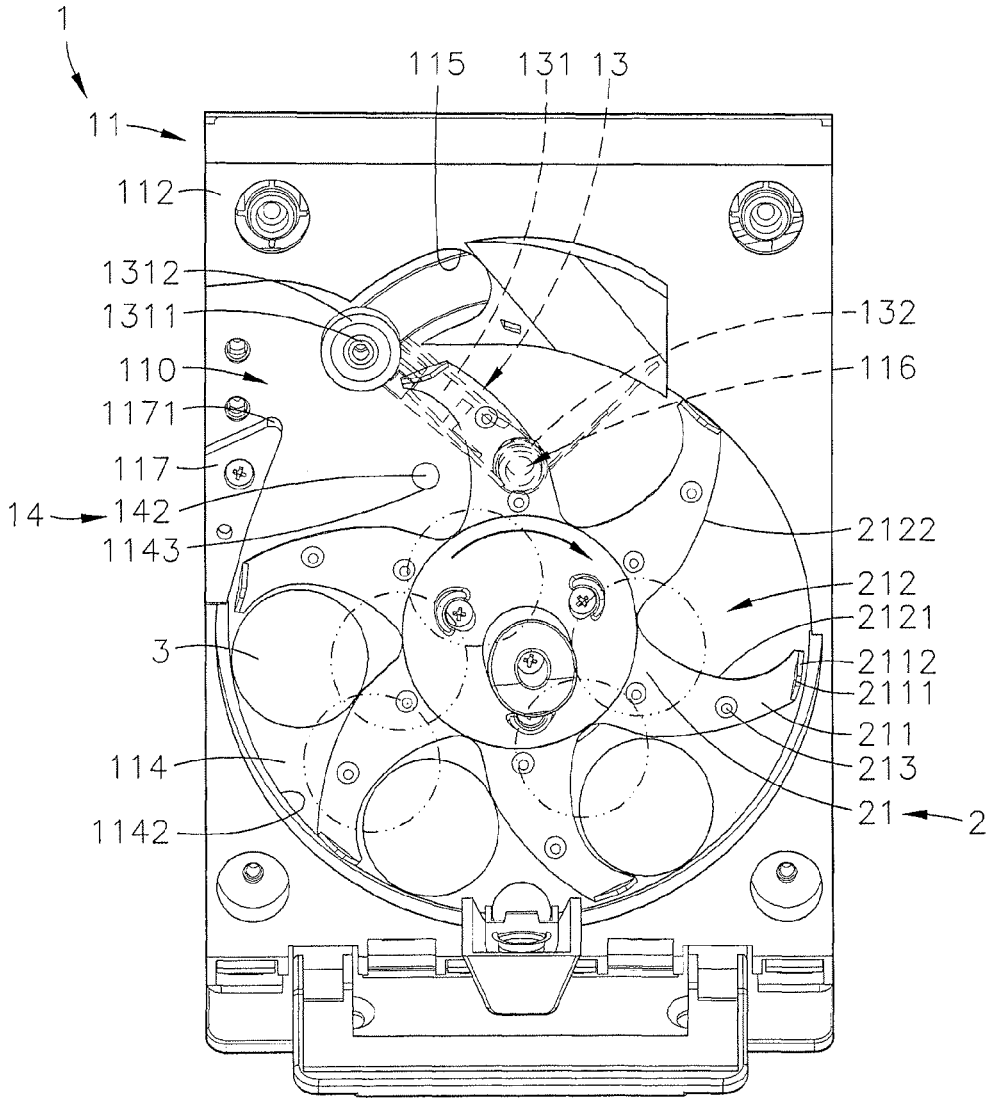
FIG. 4 is a schematic drawing of the present invention, illustrating coins moved by the rotating wheel.

Referring to FIGS. 1-4, an oblique top elevational view of a coin hopper, an exploded view of the coin hopper, another exploded view of the coin hopper and a schematic drawing illustrating coins moved by the rotating wheel of the coin hopper are shown. The coin hopper comprises a hopper body 1 and a rotating wheel 2.

The hopper body 1 comprises a housing 11, a power drive 12, a coin-dispensing mechanism 13, a coin ejector 14, a sensor module 15, and a control circuit module 16. The housing 11 comprises a funnel-shaped coin box 111, and a base panel 112 affixed to the funnel-shaped coin box 111. The funnel-shaped coin box 111 comprises an accommodation chamber 10 defining a top opening 101, and an opening 113 located at a back side thereof in communication with the accommodation chamber 10. The base panel 112 comprises a circular recess 114 located at a front wall thereof and facing toward the opening 113 of the funnel-shaped coin box 111, a through hole 1141 cut through opposing front and back walls thereof at the center of the circular recess 114, and a guide edge 1142 extending along the border of the circular recess 114. The power drive 12 comprises a motor 121 mounted at the back wall of the base panel 112 of the housing 11 opposite to the funnel-shaped coin box 111, and a transmission mechanism 122 that comprises a driving shaft 1221 inserted through the through hole 1141 at the center of the circular recess 114 and coupled to and rotatable by the motor 121.

The housing 11 further comprises a coin outlet 110 defined between the base panel 112 and the funnel-shaped coin box 111, and extended from the circular recess 114 to the outside of the hopper body 1. The base panel 112 further comprises a smoothly curved position-limit slot 115 cut through the opposing front and back walls thereof and disposed in communication with the inner end of the coin outlet 110 and the circular recess 114, and an axle 116 located at the back wall thereof above the power drive 12. The coin-dispensing mechanism 13 comprises a lever 131 pivotally coupled with its one end to the axle 116, a torsion spring 132 mounted on the axle 116 and stopped with its one end against the base panel 112 and its other end against the lever 131, a pin 1311 extended from an opposite end, namely, the free end of the lever 131 and inserted through the smoothly curved position-limit slot 115, and a bearing 1312 pivotally mounted on the pin 1311. The housing 11 further comprises a baffle 117 located at the base panel 112 at a bottom side of the coin outlet 110 and abutted to the border of the circular recess 114. The baffle 117 has an arched flange 1171 facing toward the bearing 1312 of the coin-dispensing mechanism 13, and defined with the bearing 1312 of the lever 131 a gap that has a width smaller than the size (such as length, width or outer diameter) of the coins 3.

Further, the base panel 112 of the housing 11 has a through hole 1143 cut through the circular recess 114 at a lower side relative to the coin outlet 110. The coin ejector 14 comprises a leaf spring 141, a push member 142, and a fastening member 143. The leaf spring 141 has opposing fixed end and free end. The fixed end of the leaf spring 141 is affixed to the back wall of the base panel 112 by the fastening member 143. The push member 142 is located at the free end of the leaf spring 141 and extended out of the through hole 1143. The push member 142 is preferably a steel round ball joined to the free end of the leaf spring 141. In actual application, the push member 142 can be a cylindrical or oval-shaped steel member joined to the free end of the leaf spring 141, or a dome-shaped portion integrally formed on the free end of the leaf spring 141.

Further, coins 3 of the same size and value, or of different sizes and different values can be put in the accommodation chamber 10 of the funnel-shaped coin box 111 of the housing 11. Further, decompression boards 1111 are pivotally mounted in the accommodation chamber 10 of the funnel-shaped coin box 111 to divide the internal holding space of the accommodation chamber 10 into multiple spaces, avoiding excessive concentration of coins 3 and enhancing coin dispensing stability and smoothness. The sensor module 15 is mounted at the back wall of the base panel 112 to face toward the coin outlet 110 for detecting coins 3 that pass through the coin outlet 110. The housing 11 further comprises a hollow back cover 118 jointed to the back wall of the base panel 112. The hollow back cover 118 defines therein a mounting chamber 1181. The sensor module 15 is mounted in the mounting chamber 1181, and electrically coupled with the power drive 12 and the control circuit module 16 for controlling their operation.

The rotating wheel 2 comprises a wheel base 21 having a raised configuration, and a plurality of coin-pushing blades 211 radially and equiangularly extended from the wheel base 21. The coin-pushing blades 211 are curved blades curving in a counter-clockwise direction, each having a width gradually reducing in direction away from the wheel base 21. Further, a coin-receiving space 212 is defined between each two adjacent coin-pushing blades 211. Further, each coin-pushing blade 211 comprises a coin-dispensing strip 2111 perpendicularly extended from the distal end thereof remote from the wheel base 21 and terminating in an inwardly reduced bevel guide edge 2112, an arc-shaped abutment edge 2121 extending along one lateral side thereof, a smoothly curved pushing edge 2122 extending along an opposite lateral side thereof, and at least one raised bearing portion 213 located at a front surface thereof.

When assembling the coin hopper of the present invention, position the wheel base 21 of the rotating wheel 2 in the circular recess 114 of the base panel 112 of the housing 11 of the hopper body 1, and then join the wheel base 21 to the driving shaft 1221 of the transmission mechanism 122 of the power drive 12 so that starting the motor 121 of the power drive 12 can drive the driving shaft 1221 of the transmission mechanism 122 to rotate the rotating wheel 2. After installation of the rotating wheel 2 in the circular recess 114 of the base panel 112 of the housing 11 of the hopper body 1, a gap is left between the coin-pushing blade 211 and the guide edge 1142, and thus, the rotating wheel 2 does not touch the baffle 117 and the coin-dispensing mechanism 13 during its rotation, preventing generation of friction resistance to affect coin dispensing operation. Thereafter, respectively fasten the funnel-shaped coin box 111 and hollow back cover 118 of the housing 11 to the front and back walls of the base panel 112 with screws, keeping the rotating wheel 2 to face toward the opening 113 of the funnel-shaped coin box 111, and thus, the coin hopper is assembled.

Figure 5:
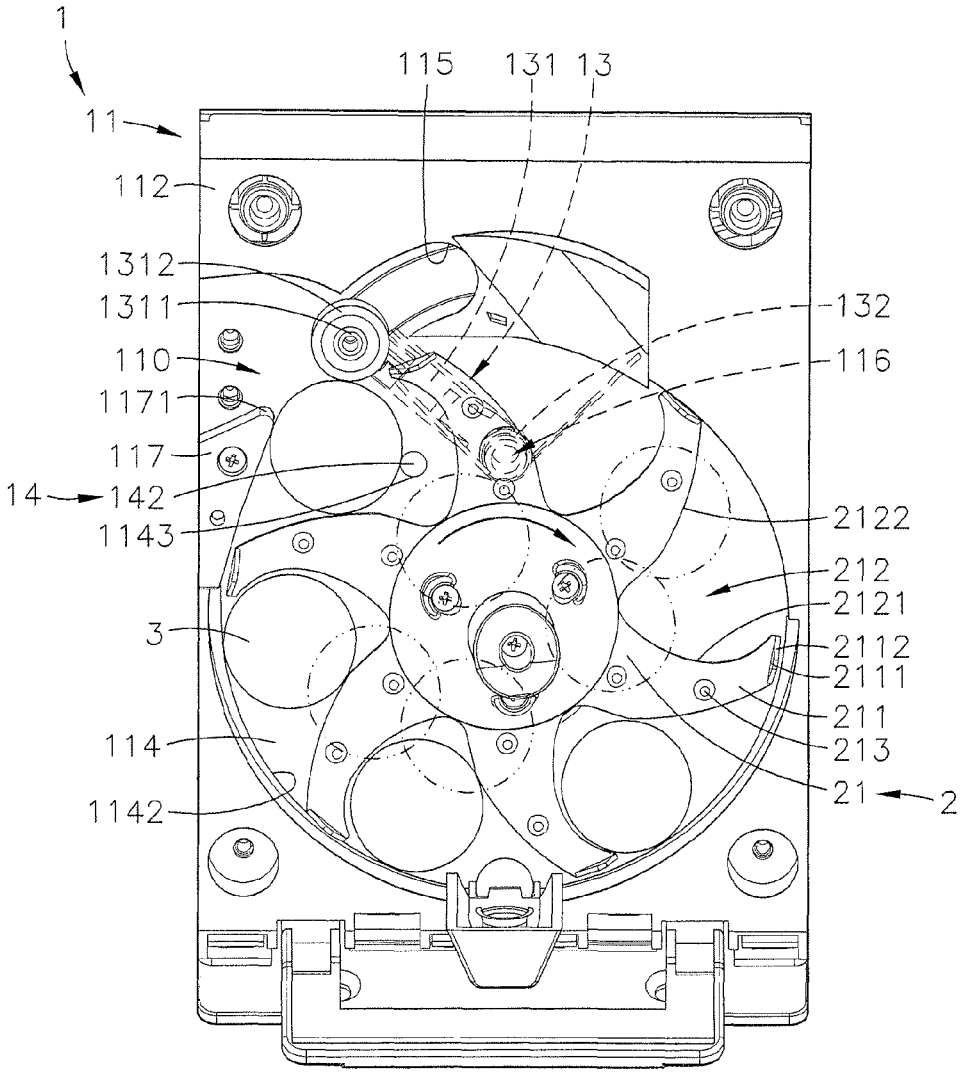
FIG. 5 corresponds to FIG. 4, illustrating one coin moved to the coin-dispensing mechanism toward the coin outlet.
Figure 6:
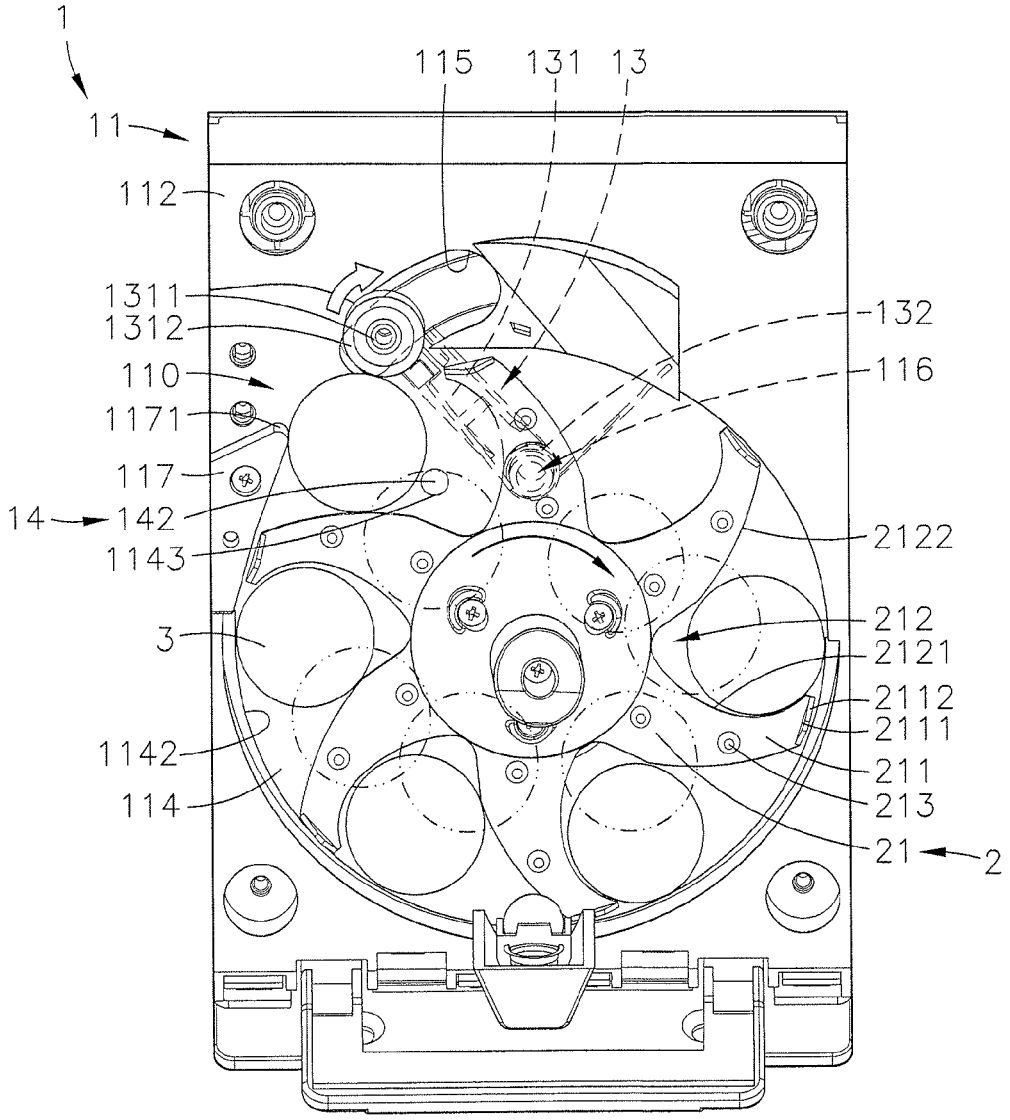
FIG. 6 corresponds to FIG. 5, illustrating the lever of the coin-dispensing mechanism biased by the coin.
Figure 7:
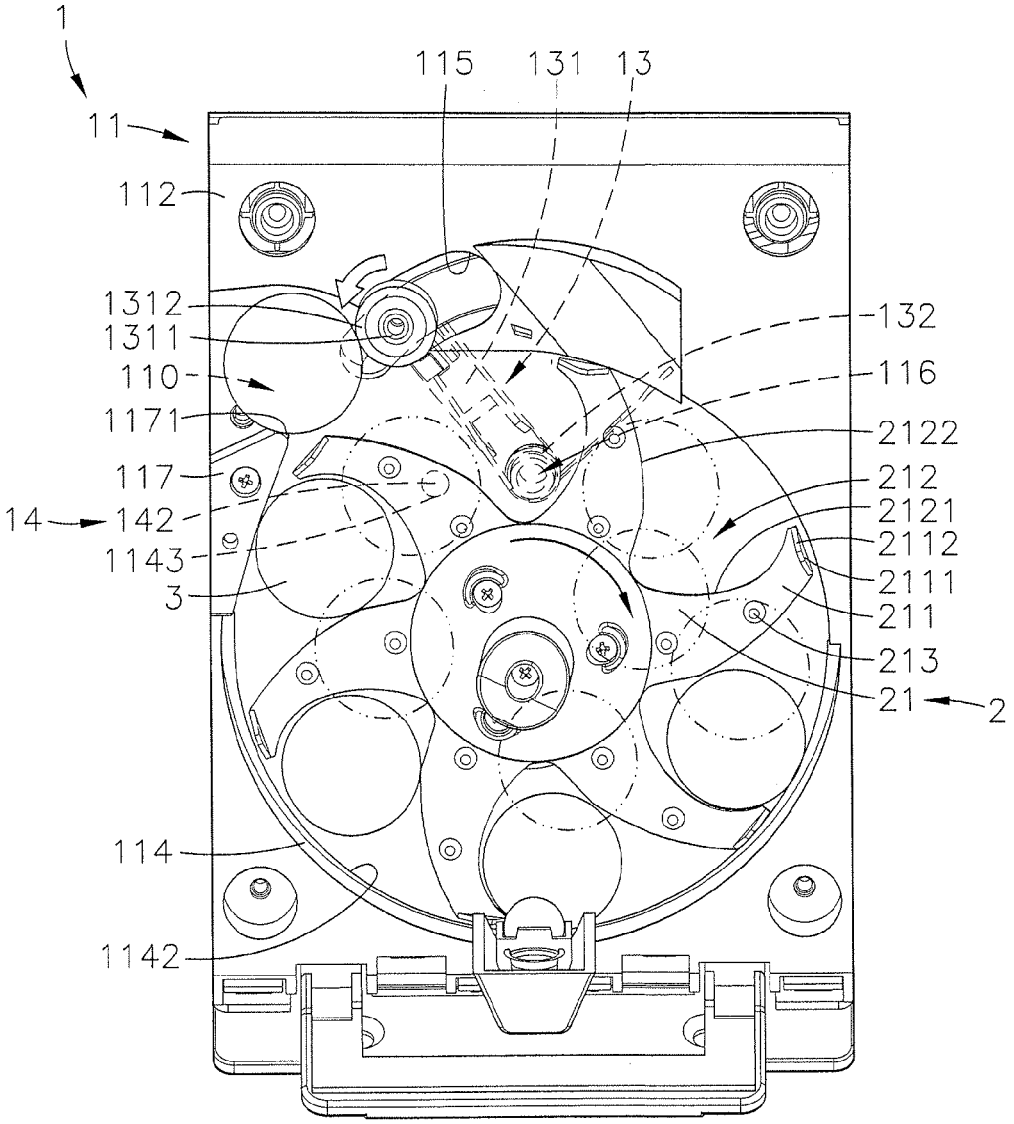
FIG. 7 corresponds to FIG. 6, illustrating the coin moved over the lever toward the coin outlet.
Figure 8:
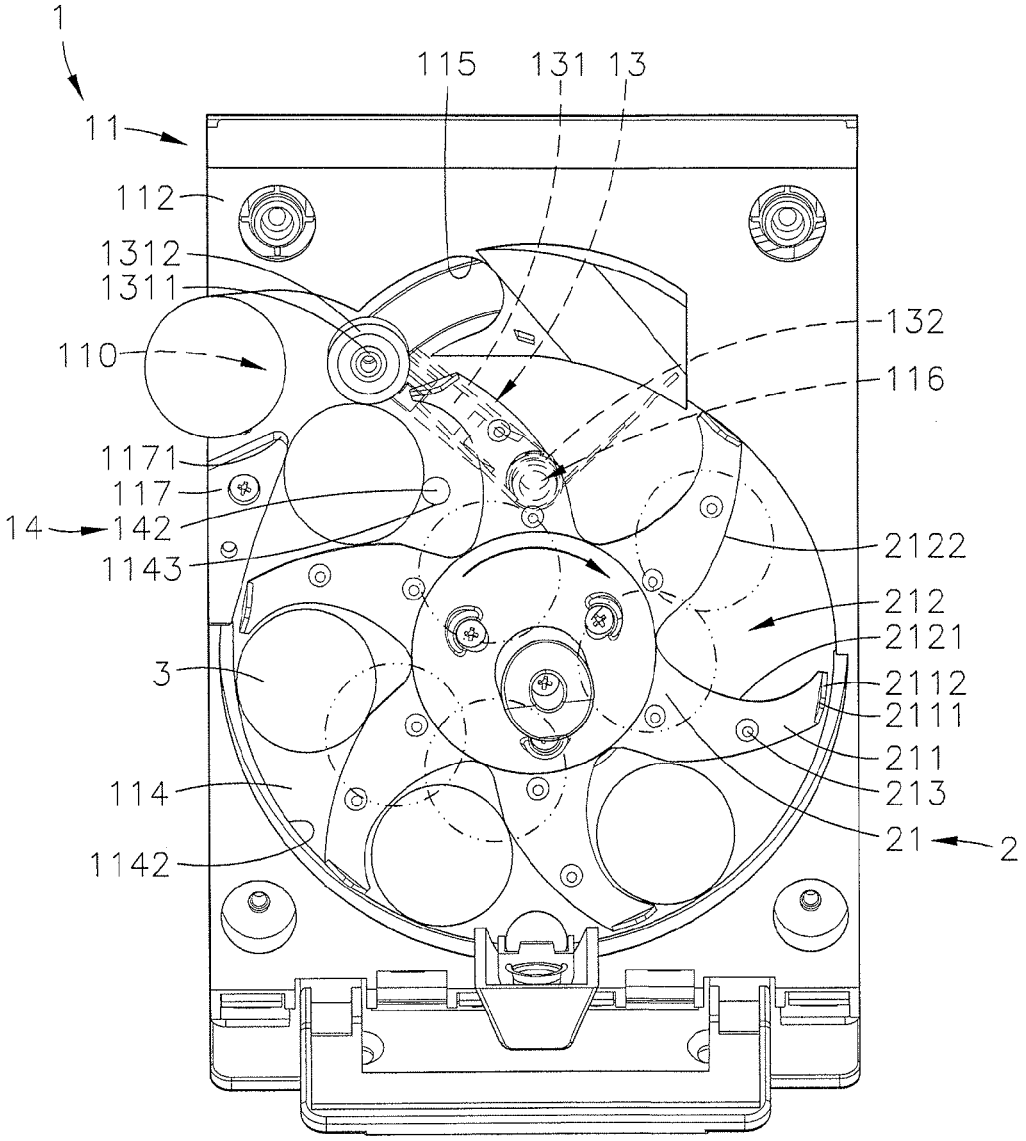
FIG. 8 corresponds to FIG. 7, illustrating the lever returned, and the coin ejected toward the outside of the coin outlet.
Figure 9:
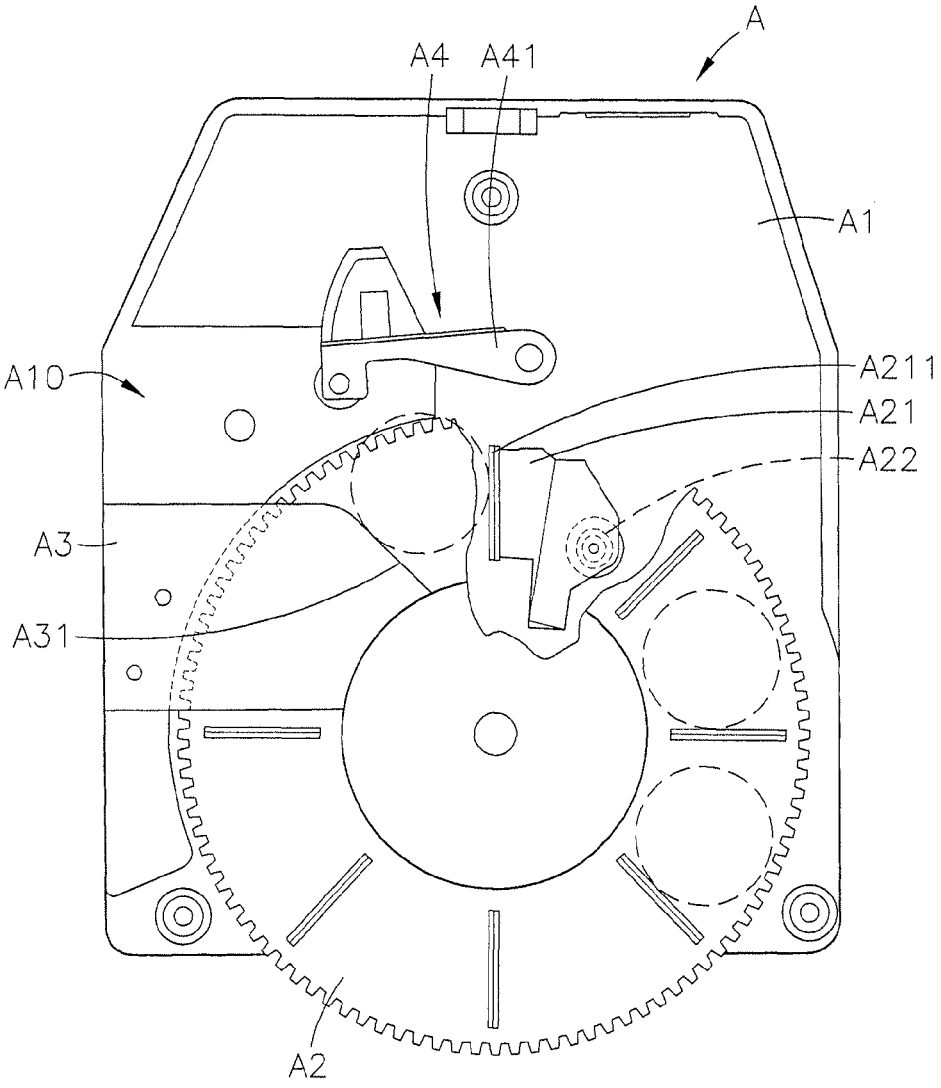
PRIOR ART FIG. 9
FIG. 9 is a front view of a coin hopper according to the prior art.
Figure 10:
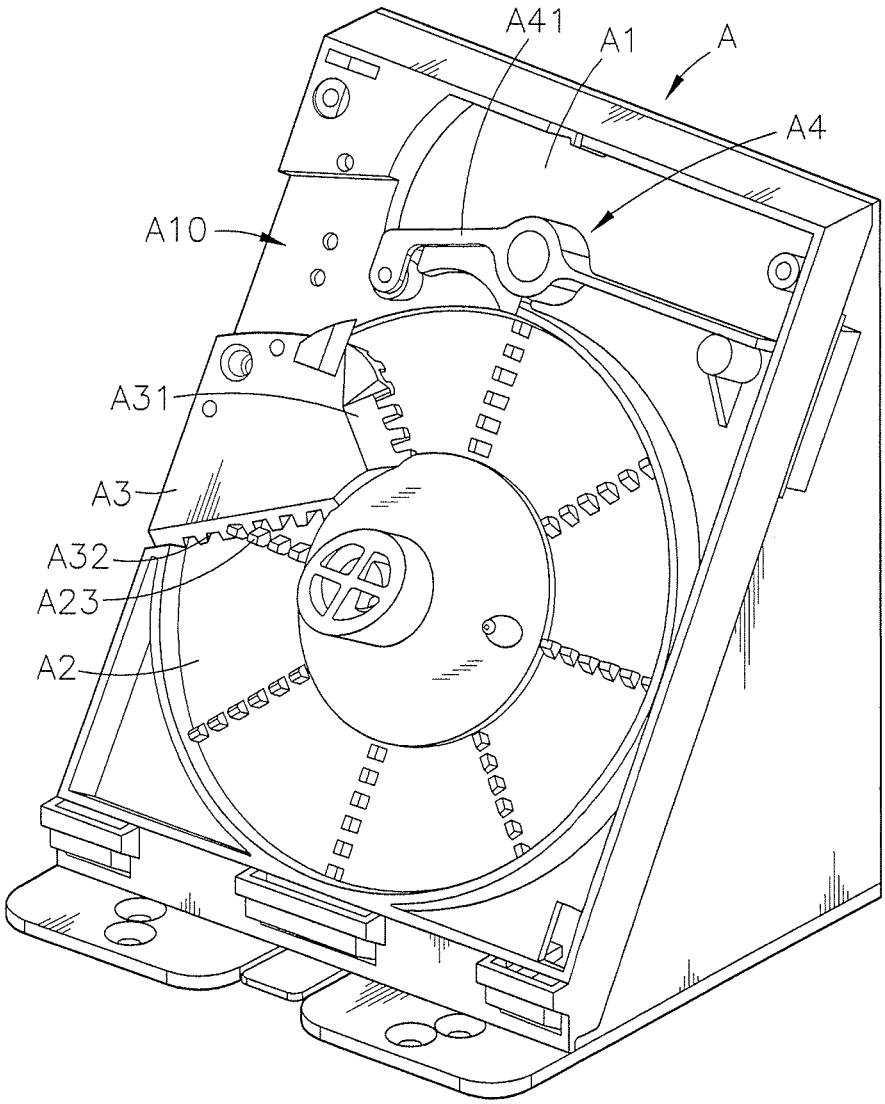
PRIOR ART FIG. 10
FIG. 10 is an oblique top elevational view of a coin dispenser according to the prior art.

Referring to FIGS. 5-8, the coin hopper can be used in an automatic vending machine or game machine, or a consumer system designed to provide commodity purchase or consumer services. In application, mount the hopper body 1 in the host of the automatic vending machine, game machine or consumer system, and electrically connect the control circuit module 16 to host with a transmission cable or bus. Further, the coin hopper can also be used independently. With respect to the functions that how the control circuit module 16 controls the motor 121 of the power drive 12 to driven the transmission mechanism 122 in rotating the rotating wheel 2, and how the sensor module 15 detects the amount, value, authenticity and dispensing of coins are of the known art and not within the scope of the claims of the present invention, no further detailed description in this regard will be necessary.

When coins 3 are put through the top opening 101 of the housing 11 of the hopper body 1 into the accommodation chamber 10 of the funnel-shaped coin box 111, coins 3 are cumulated in the accommodation chamber 10. At this time, turn on the motor 121 of the power drive 12 to drive the transmission mechanism 122 in rotating the rotating wheel 2 clockwise. During rotation of the rotating wheel 2, coins 3 are ruffled by the coin-pushing blades 211 of the rotating wheel 2 to fall into the coin-receiving spaces 212, and then guided by the arc-shaped abutment edges 2121 of the coin-pushing blades 211 and the guide edge 1142 around the circular recess 114 to move along the guide edge 1142 around the circular recess 114 upwardly toward the coin-dispensing mechanism 13 in the coin outlet 110 one after another. When one coin 3 is moved along the baffle 117 toward the coin-dispensing mechanism 13, the centrifugal force created during rotation of the rotating wheel 2 forces the coin 3 to move along the smoothly curved pushing edge 2122 of one coin-pushing blade 211 out of the respective coin-receiving space 212, and the coin 3 is then pushed by one coin-pushing blade 211 to abut against the bearing 1312 at the lever 131 and the arched flange 1171 of the baffle 117. At this time, the lever 131 is forced by the coin 3 to bias relative to axle 116, thereby increasing the gap between the bearing 1312 at the lever 131 and the arched flange 1171 of the baffle 117 for the passing of the coin 3. After passed through the gap between the bearing 1312 and the arched flange 1171, the coin 3 enters the coin outlet 110, and the elastic potential energy of the torsion spring 132 forces the lever 131 to return to its former position, and thus, the coin 3 is stopped against the arched flange 1171 of the baffle 117 and ejected by the bearing 1312 of the lever 131 out of the coin outlet 110 of the housing 11, achieving a coin dispensing action. The structural design of the coin-pushing blades 211 and coin-receiving spaces 212 of the rotating wheel 2 effectively achieves coin dispensing without an extra control plate or back plate. If a plastic control plate or back plate is used, the plastic control plate or back plate can wear out quickly due to friction against coins 3, leading to coin dispensing problems. Thus, the invention saves much labor and time cost in control plate replacement, enhancing practicability of the coin hopper. During rotation of the rotating wheel 2, the coin-pushing blades 211 and coin-receiving spaces 212 of the rotating wheel 2 work to push coins 3 individually toward the coin outlet 110 of the housing 11, the bearing 1312 of the coin-dispensing mechanism 13 is moved with the lever 131 alternatively back and forth to eject every individual coin 3 out of the coin outlet 110. Even if one coin-receiving space 212 or multiple coin-receiving spaces 212 of the rotating wheel 2 are empty, the coin-pushing blades 211 are continuously rotated with the rotating wheel 2, the coin-pushing blades 211 can keep pushing coins 3 individually out of the other coin-receiving spaces 212 toward the coin outlet 110. If another coin 3 is forced to fall into the coin-receiving space 212 during rotation of the rotating wheel 2 to move one coin 3 out of the respective coin-receiving space 212 to the coin outlet 110 individually, this coin 3 will be pushed by the push member 142 of the coin ejector 14 downwardly away from the respective coin-pushing blade 211, preventing jamming of the coin 3 in the gap between the coin-pushing blade 211 and the circular recess 114, or an occurrence of a structural damage. When one coin-pushing blade 211 touches the push member 142, the push member 142 will be forced to move back to the inside of the through hole 1143 and to simultaneously compress the leaf spring 141. After the coin-pushing blade 211 passed over the push member 142, the elastic potential energy of the leaf spring 141 immediately forces the push member 142 out of the through hole 1143 into a floating condition.

Further, if overlapped coins 3 are simultaneously moved by one coin-pushing blade 211 of the rotating wheel 2, due to that the thickness of the coins 3 is smaller than the height of the coin outlet 110, a first coin 3 of the overlapped coins 3 can be pushed into the coin outlet 110 and then rapidly ejected out of the coin outlet 110 by the lever 131 of the coin-dispensing mechanism 13. If a second coin 3 of the overlapped coins 3 is moved with the first coin 3 to the coin outlet 110, this second coin 3 will be disposed above the height of the coin outlet 110 due to the effect of the thickness of the coin-pushing blades 211 of the rotating wheel 2, and will then be forced to fall from the surface of the first coin 3. At this time, the raised bearing portion 213 of the respective coin-pushing blade 211 can touch the second coin 3 or the other coins 3 above the first coin 3, moving the second coin 3 or the other coins 3 downwardly away from the coin-pushing blades 211 of the rotating wheel 2. Further, the bevel guide edge 2112 of the coin-dispensing strip 2111 of each coin-pushing blade 211 can also move the second coin 3 or the other coins 3 downwardly away from the surface of first coin 3 that is been moved into the coin outlet 110, allowing the first coin 3 to be smoothly moved into the coin outlet 110 and then pushed out of the coin outlet 110. Thus, the invention effectively prevents the rotating wheel 2 from delivering overlapped coins 3 into the coin outlet 110 to cause jammed coin or coin outlet blockage.

In conclusion, the invention provides a coin hopper, which comprises a hopper body 1, and a rotating wheel 2 that comprises a wheel base 21, a plurality of curved coin-pushing blades 211 radially and equiangularly spaced around the wheel base 21 and a coin-receiving space 212 defined between each two adjacent coin-pushing blades 211. When a power drive 12 of the hopper body 1 is started to rotate the rotating wheel 2, coins 3 in a funnel-shaped coin box 111 of the housing 11 are ruffled by the coin-pushing blades 211 and forced into the coin-receiving spaces 212 individually and then guided by the arc-shaped abutment edges 2121 of the coin-pushing blades 211 to move out of the coin-receiving space 212 upwardly toward the coin outlet 110 one after another for dispensing. The structural design of the rotating wheel 2 can achieve coin dispensing without an extra control plate. If a plastic control plate is used, the plastic control plate can wear out quickly due to friction against coins, leading to coin dispensing problems. Thus, the invention saves much labor and time cost in control plate replacement, enhancing practicability of the coin hopper.

It is to be understood that the above-described embodiment of the invention is merely a possible example of implementations, merely set forth for a clear understanding of the principles of the invention, many modifications and enhancements may be made without departing from the spirit and scope of the invention. Accordingly, the invention is not to be limited except as by the appended claims.

What the invention claimed is:

1. A coin hopper, comprising a hopper body and a rotating wheel, wherein:

said hopper body comprises a housing, said housing comprising a funnel-shaped coin box, an accommodation chamber defined in said funnel-shaped coin box for accommodating coins to be dispensed and a coin outlet disposed in communication with said accommodation chamber for guiding said coins out of said accommodation chamber individually, and a power drive adapted for rotating said rotating wheel to push said coins out of said accommodation chambers into said coin outlet individually;

said rotating wheel comprises a wheel base pivotally mounted in said housing, a plurality of coin-pushing blades radially and equiangularly extended from said wheel base and a coin-receiving space defined between each two adjacent said coin-pushing blades for receiving one said coin, said coin-pushing blades being curved blades curving in a counter-clockwise direction and having a width gradually reducing in direction away from said wheel base, each said coin-pushing blade comprising an abutment edge extending along one lateral side thereof for stopping one said coin in one said coin-receiving space and a pushing edge extending along an opposite lateral side thereof for pushing one said coin out of one said coin-receiving space into said coin outlet during rotation of said rotating wheel; and each said coin-pushing blade of said rotating wheel comprises a coin-dispensing strip perpendicularly extended from a distal end thereof remote from said wheel base, said coin-dispensing strip comprising an inwardly reduced bevel guide edge adapted for pushing one of each two overlapped said coins backwardly out of said coin outlet.

2. The coin hopper as claimed in claim 1, wherein said hopper body further comprises a base panel affixed to said funnel-shaped coin box of said housing, said base panel comprising a circular recess located at a front wall thereof and facing toward said opening of said funnel-shaped coin box; said rotating wheel is pivotally mounted in said circular recess of said base panel and suspending in said opening of said housing.

3. The coin hopper as claimed in claim 2, wherein said base panel comprises a guide edge extending along the border of said circular recess for stopping a coin in one said coin-receiving space of said rotating wheel against one said abutment edge.

4. The coin hopper as claimed in claim 2, wherein said base panel further comprises a through hole cut through said circular recess at the center; said power drive comprises a motor mounted at a back wall of said base panel opposite to said funnel-shaped coin box, and a transmission mechanism coupled to and rotatable by said power drive, said transmission mechanism comprising a driving shaft inserted through said through hole of said base panel and coupled with said wheel base of said rotating wheel.

5. The coin hopper as claimed in claim 2, wherein said coin outlet is defined between a border area of said circular recess of said base panel and a back wall of said funnel-shaped coin box of said housing for guiding said coins out of said hopper body individually.

6. The coin hopper as claimed in claim 2, wherein said base panel further comprises a second through hole cut through said circular recess at a lower side relative to said coin outlet; said hopper body further comprises a coin ejector mounted at said base panel, said coin ejector comprising a leaf spring having a fixed end and an opposing free end, a fastening member affixing said fixed end of said leaf spring to the back wall of said base panel, and a push member located at said free end of said leaf spring and inserted through said second through hole of said base panel and suspended in said circular base.

7. The coin hopper as claimed in claim 1, wherein said hopper body further comprises a coin-dispensing mechanism disposed in said housing at an inner side relative to said coin outlet, said coin-dispensing mechanism comprising a lever pivotally connected to said base panel and adapted for pushing each said coin out of said coin outlet, and a torsion spring loaded on said lever for proving an elastic potential energy to said lever.

8. The coin hopper as claimed in claim 7, wherein said base panel of said housing comprises a smoothly curved position-limit slot cut through the opposing front and back walls thereof and extended from an inner end of said coin outlet and the border of said circular recess, and an axle located at the back wall thereof; said lever of said coin-dispensing mechanism has one end thereof connected to said axle; said coin-dispensing mechanism further comprises a pin located at an opposite end of said lever and inserted through said smoothly curved position-limit slot, and a bearing pivotally mounted on said pin and adapted for pushing each said coin out of said coin outlet.

9. The coin hopper as claimed in claim 8, wherein said housing of said hopper body further comprises a baffle located at the front wall of said base panel at a bottom side of said coin outlet and abutted to the border of said circular recess, said baffle comprising an arched flange facing toward said bearing of said coin-dispensing mechanism and defined with said bearing of said coin-dispensing mechanism a gap for the passing of said coins individually into said coin outlet.

10. The coin hopper as claimed in claim 1, wherein said wheel base of said rotating wheel has a raised configuration; said coin-pushing blades of said rotating wheel are curved blades curving in a counter-clockwise direction; the abutment edge of each said coin-pushing blade is arc-shaped; the pushing edge of each said coin-pushing blade is smoothly curved.

11. The coin hopper as claimed in claim 1, wherein each said coin-pushing blade of said rotating wheel comprises at least one raised bearing portion located at a front surface thereof.

* * * * *